US009261838B2

(12) United States Patent
Bayer et al.

(10) Patent No.: US 9,261,838 B2
(45) Date of Patent: Feb. 16, 2016

(54) PRINTING ARRANGEMENT FOR TWO-SIDED PRINTING ON A RECORDING MEDIUM AND PRINTING METHOD

(71) Applicant: Océ Printing Systems GmbH & Co. KG, Poing (DE)

(72) Inventors: Andreas Bayer, Poing (DE); Alexander Breitenbach, Graefelfing (DE); Stefan Roehl, Munich (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/166,163

(22) Filed: Jan. 28, 2014

(65) Prior Publication Data

US 2014/0212631 A1 Jul. 31, 2014

(30) Foreign Application Priority Data

Jan. 30, 2013 (DE) ..... 10 2013 201 552

(51) Int. Cl.

| | |
|---|---|
| ***G03G 21/20*** | (2006.01) |
| ***G03G 15/23*** | (2006.01) |
| ***G03G 15/10*** | (2006.01) |
| ***G03G 15/20*** | (2006.01) |

(52) U.S. Cl.

CPC ..... *G03G 15/23* (2013.01); *G03G 15/2003* (2013.01); *G03G 15/235* (2013.01); *G03G 21/20* (2013.01); *G03G 2215/1666* (2013.01); *Y10T 428/24802* (2015.01); *Y10T 428/24934* (2015.01)

(58) Field of Classification Search

CPC ..... G03G 15/235; G03G 15/101; G03G 2215/1666; G03G 15/10; G03G 15/23; Y10T 428/24802; Y10T 428/24934

USPC ..... 428/195.1, 211.1; 399/364

See application file for complete search history.

(56) References Cited

U.S. PATENT DOCUMENTS

| | | | |
|---|---|---|---|
| 5,140,377 | A | 8/1992 | Lewis |
| 7,848,668 | B2 | 12/2010 | Condello et al. |
| 7,890,043 | B2 | 2/2011 | Biegelsen et al. |
| 2011/0150534 | A1 | 6/2011 | Kopp |

(Continued)

FOREIGN PATENT DOCUMENTS

| | | |
|---|---|---|
| DE | 2003 992 | 10/1970 |
| DE | 197 55 584 | 6/1999 |
| DE | 103 01 587 | 8/2004 |

(Continued)

OTHER PUBLICATIONS

German Office Action for Application No. 10 2013 201552.6 dated Jul. 15, 2013.

(Continued)

*Primary Examiner* — Bruce H Hess

(74) *Attorney, Agent, or Firm* — Jenkins, Wilson, Taylor & Hunt, P.A.

(57) ABSTRACT

A printing arrangement and printing method are disclosed for two-sided printing on a recording medium, in which intermediate fixing by superheated steam takes place after printing on the first side of the recording medium. Owing to the intermediate fixing, damage to the print image of the first side during subsequent printing on the second side is avoided without the recording medium being impaired by the intermediate fixing.

6 Claims, 12 Drawing Sheets

(56) References Cited

U.S. PATENT DOCUMENTS

| | | | |
|---|---|---|---|
| 2012/0287450 | A1 | 11/2012 | Nishi |
| 2014/0212632 | A1 | 7/2014 | Bayer |

FOREIGN PATENT DOCUMENTS

| | | |
|---|---|---|
| DE | 10 2004 009 987 | 10/2005 |
| DE | 20 2004 020 953 | 5/2006 |
| DE | 10 2008 048 256 | 4/2010 |
| DE | 10 2009 060 334 | 6/2011 |
| DE | 10 2010 015 985 | 9/2011 |
| JP | 2006/350263 | 12/2006 |
| WO | WO 2005/083528 | 9/2005 |

OTHER PUBLICATIONS

German Office Action for Application No. 10 2013 201 549.6 dated Nov. 11, 2013.

Restriction Requirement for U.S. Appl. No. 14/166,312 dated Jan. 23, 2015.

Non-Final Office Action for U.S. Appl. No. 14/166,312 dated Jun. 5, 2015.

PRINTING ARRANGEMENT FOR TWO-SIDED PRINTING ON A RECORDING MEDIUM AND PRINTING METHOD

CROSS-REFERENCE TO RELATED APPLICATION

This application claims the benefit of and priority to German Patent Application No. 10 2013 201 552.6 filed Jan. 30, 2013, the entire disclosure of which is herein incorporated by reference.

TECHNICAL FIELD

The present invention relates to a printing arrangement for two-sided printing on a recording medium and to a printing method, also referred to as a duplex printing. In particular, the invention relates to a digital printer for printing on a recording medium using particles, in particular toner particles, which are applied by means of a liquid developer, in particular a high-speed printer for printing on recording media in web or sheet form.

BACKGROUND

Exemplary digital printers are known for example from DE 10 2010 015 985 A1, DE 10 2008 048 256 A1 or DE 10 2009 060 334 A1.

Two-sided printing, as for example in the case of two-sided duplex printing, in a printing system with subsequent combined fixing of the printed image on a first side and a second side opposite the first side, that is to say the front and back, of a recording medium is associated with significant problems when the front, which is printed first, is fed, after printing, directly to one or more printing units for printing on the back.

The greatest technical problem in this connection is that of finally feeding the print image, which is located on the front and which has not yet been fixed, to fixing without damaging the print image and with simultaneous printing on the back.

The unfixed print image on the recording medium, for example a printing substrate web, can be remobilised at any time under the effect of an electric field, as used for example in a printing unit of a duplex printing apparatus. In duplex printing, the printed image, for example a toner image, can on one hand be drawn onto the back of the recording medium by the electric field present between transfer roller and pressure roller (back roller). On the other hand, the already transferred print image of the front can be removed from the recording medium. In addition to damage to the print image, this also results in soiling of the pressure roller.

In general there is the option of intermediate fixing (thermally, by means of pressure, by means of solvent, infrared light, flashlight, etc.), but this is associated with other drawbacks. Furthermore, it is usually not economical to use two fixing stations. In the case of thermal fixing, the recording medium which is dehumidified after fixing causes problems in terms of printability. A high energy input is also necessary in this connection.

It should also be noted that thermal fixing stations are also relatively large, since the heat of the air and the energy input per unit area are low. When using mineral-oil-based ink systems, explosion prevention and observance of the applicable limit values for the exhaust air must also be observed.

Furthermore, the recording medium may shrink, for example in the case of paper and cardboard. In principle, this results in a relatively great deviation of the print image dimensions between front and back. The print image of the front is printed narrower owing to transverse shrinkage by 0.5 to 1% of the dimension transverse to the paper fibre and the back print is printed in the original width. Thus, without additional technical complexity, a congruent print from front to back is not possible, and this specifically is a requirement in letterpress printing. Remoistening and increasing the efficiency in the transfer can be solved only with great technical complexity. In addition, print fixing can lead to a change in the gloss.

DE 197 55 584 A1 for example thus describes melting the toner for fixing the intermediate image by means of a gas having a temperature between 150° C. and 400° C., and this can lead to the problems indicated above. Also, relatively large quantities of steam in the range of 160 l/sec are used for the method described therein.

Similar methods are described in U.S. Pat. No. 5,140,377 A, DE 2003 992 A1 and DE 103 01 587 A1.

DE 20 2004 020 953 U1 also deals with fixing a toner on a recording medium, and also explicitly addresses the problem of shrinkage of the recording medium. Since this problem is considered unavoidable in the solution described therein, a correction apparatus is proposed in order for the shrinkage not to have a negative effect on the ratio of the printing on the front and back of the recording medium.

An alternative fixing method is also known from DE 10 2004 009 987, in which the fixing takes place by means of a polymer film. However, this requires an additional application of material and also greater complexity in terms of machinery.

SUMMARY

The object of the present invention is to allow improved two-sided printing on a recording medium.

According to the invention, this object is achieved by a printing arrangement and a printing method as disclosed herein.

In this connection, the printing arrangement comprises at least one simplex printing apparatus which is designed to print on a recording medium having two opposing faces, on a first side of the recording medium, at least one duplex printing apparatus which is designed to print on a second side of the recording medium, which is opposite the first side printed on by the simplex printing apparatus, and an intermediate fixing apparatus which is arranged between the simplex printing apparatus and the duplex printing apparatus and which is designed to intermediately fix the first side of the recording medium, printed on by the simplex printing apparatus, by superheated steam, the intermediate fixing apparatus (29) being designed such that it provides superheated steam (300), by which the first side of the recording medium (20) can be intermediately fixed.

In addition, the invention relates in a further aspect to a printing method for two-sided printing on a recording medium, in which method two opposing sides of a recording medium are printed on, in particular by the printing arrangement according to the invention, comprising:

- providing at least one simplex printing apparatus, at least one duplex printing apparatus and a recording medium to be printed on;
- printing on a first side of the recording medium using the simplex printing apparatus;
- intermediately fixing the first side of the recording medium, printed on by the simplex printing apparatus, using superheated steam; and
- printing on a second side of the recording medium, which second side is arranged opposite the first side which has been printed on by the simplex printing apparatus and intermediately fixed, using the duplex printing apparatus.

In a further aspect, the invention also relates to a recording medium produced by the method according to the invention.

The invention is based on a method and a device for intermediate fixing of a recording medium provided for two-sided printing. The aim is to intermediately fix the simplex print image located on the front in such a way that it remains as undamaged as possible on the front, for example in the case of an electrophoretically-assisted transfer on the back. A further aim is not to influence the recording medium, in particular to allow substantially no shrinkage of the recording medium to occur.

The solution to the problem is implemented by pre-fixing the simplex print image by superheated steam. For this purpose, the unfixed print image is exposed to hot, saturated steam without condensation nuclei for a certain period, for example for more than 1 second. The method can be used for variable printing speeds and different types of recording media, for example different types of paper, over the length of the steam path.

Owing to the high energy input of the superheated steam as a result of the large heat capacity of water compared to air, very rapid intermediate fixing of the print image takes place. If the simplex print image of the front is now fed to the duplex printing unit, retransfer onto the components of the duplex printing apparatus, for example onto a pressure roller, is reduced to an acceptable amount.

Advantageous configurations and developments emerge from the further dependent claims and from the description with reference to the figures of the drawings.

BRIEF DESCRIPTION OF THE DRAWINGS

The present invention will be described below with reference to the embodiments indicated in the schematic figures of the drawings, in which.

Figure 1:
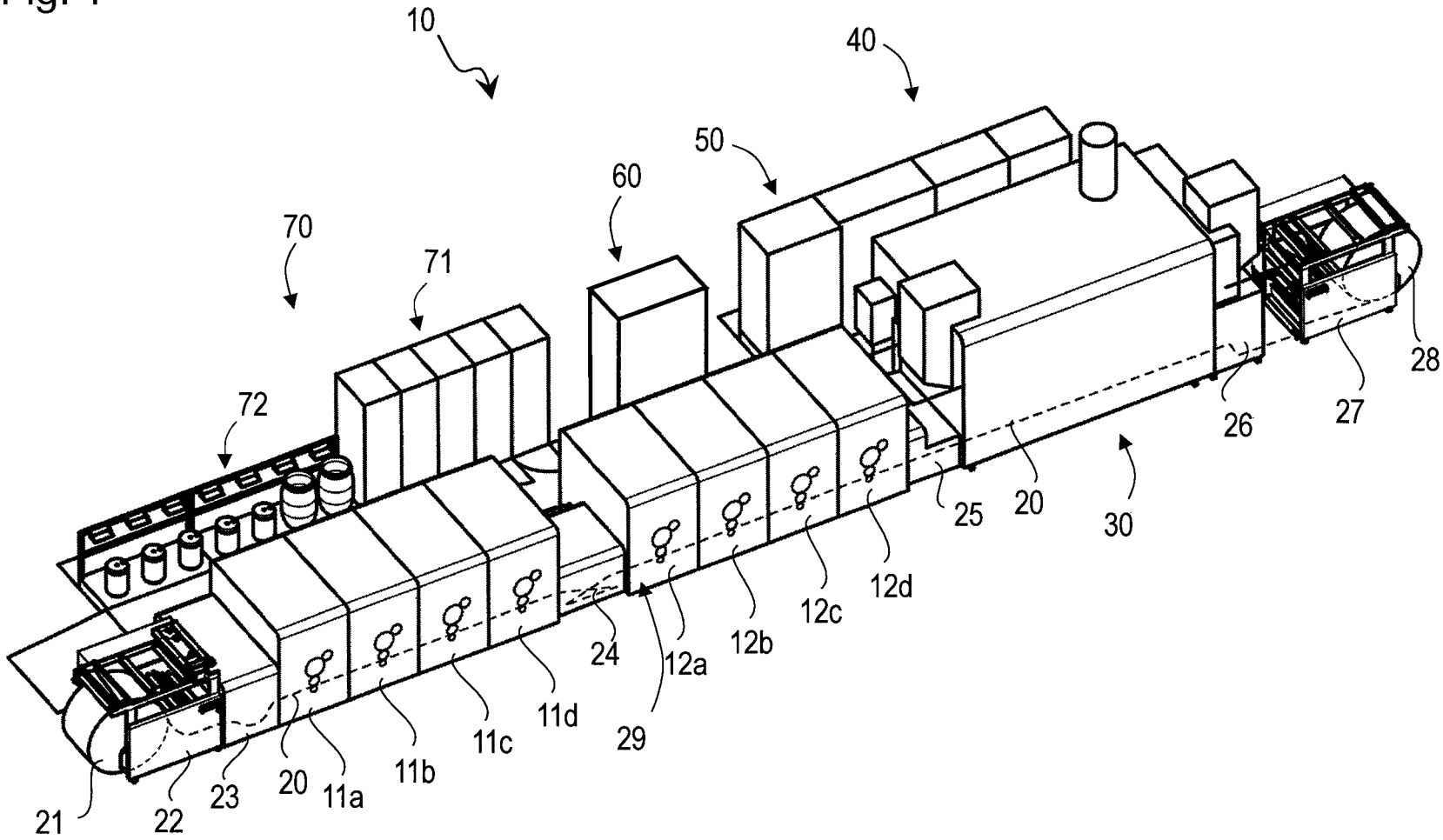
FIG. 1 is a view of a digital printer in the case of an exemplary configuration of the digital printer.

The elements in the drawings are not necessarily shown true to scale in relation to one another.

In the figures of the drawings, elements, features and components which are like, functionally like or have a like effect are each provided with the same reference numerals, unless indicated otherwise.

DETAILED DESCRIPTION

First, in the context of the present patent application the following terms are to be understood as follows:

In the context of the invention, a simplex printing apparatus denotes a device within which an image is applied to a first side of a recording medium by a printing material.

A duplex printing apparatus denotes a device within which an image is applied to a second side of the recording medium, which is opposite the first side of the recording medium, by a printing material, such that a printing material has been applied to the two sides of the recording medium after passage through the duplex printing apparatus.

Superheated steam denotes superheated water vapour, that is to say hot, saturated steam without condensation nuclei, and thus at least water in the gaseous state having a temperature at or above the boiling temperature of the water. In this connection, the superheated steam is "dry", that is to say contains no condensation nuclei or water droplets during the application prior to impingement on the recording medium or the printing material of the simplex print image. In particular, the term superheated steam does not include wet steam. However, upon or after impingement of the superheated steam on the recording medium or the printing material, water droplets can form on the recording medium owing to the interaction herewith.

In the context of the invention, water droplets are liquid droplets of water having a temperature below the boiling point of water, for example 100° C. at normal pressure, which are present in the form of a drop. In particular, water in solid form or gaseous form is not included by this term.

In the context of the invention, intermediate fixing means that fixing takes place spatially between the printing in a simplex printing apparatus and the printing in a duplex printing apparatus. In this connection, however, intermediate fixing is also to be understood in contrast to fixing in which the print image/the particles on the recording medium are fixed thereto, for example by melting. In contrast, the intermediate fixing in the context of the invention includes an improvement in the adhesion of a printing material, for example a printing liquid and/or of particles contained therein, to the recording medium, without resulting in fixing of the printing material on the surface of the recording medium. In this connection, crosslinking of the particles can also take place near the surface.

The invention relates to a printing arrangement for two-sided printing on a recording medium, and in particular to a digital printer for printing on a recording medium using toner particles which are applied by a liquid developer, preferably a high-speed printer for printing on recording media, more preferably recording media in web or sheet form.

In the case of digital printers, a latent charge image of a charge image carrier is inked, in certain embodiments by a liquid developer by electrophoresis. The resulting image is transferred to the recording medium directly or indirectly via a transfer element. The liquid developer used in certain embodiments may comprise toner particles and carrier liquid in a desired ratio. Mineral oil is preferably used as carrier liquid. In order to provide the toner particles with an electrostatic charge, charge control agents are added to the liquid developer in certain embodiments. In addition, further additives may be added in order for example to obtain the desired viscosity or desired drying properties of the liquid developer.

In the case of two-sided printing, an image is applied to the recording medium on a first side or front and also subsequently to a second side or back, which is opposite the first side.

Prior to the application on the second side, the image is usually fixed on the first side, as indicated above, in order to prevent removal onto an impression roller in the duplex printing apparatus, although this is associated with the above-mentioned problems.

The solution to the problems is implemented by treating the simplex print image with superheated steam. For this purpose, the unfixed print image is exposed to superheated steam on the first side, for example over a particular path.

If the simplex print image of the front, which has been exposed to superheated steam, is then fed to the duplex printing unit, retransfer onto the pressure roller, for example also owing to the influence of an electric field, is reduced to an acceptable amount.

Figure 2:
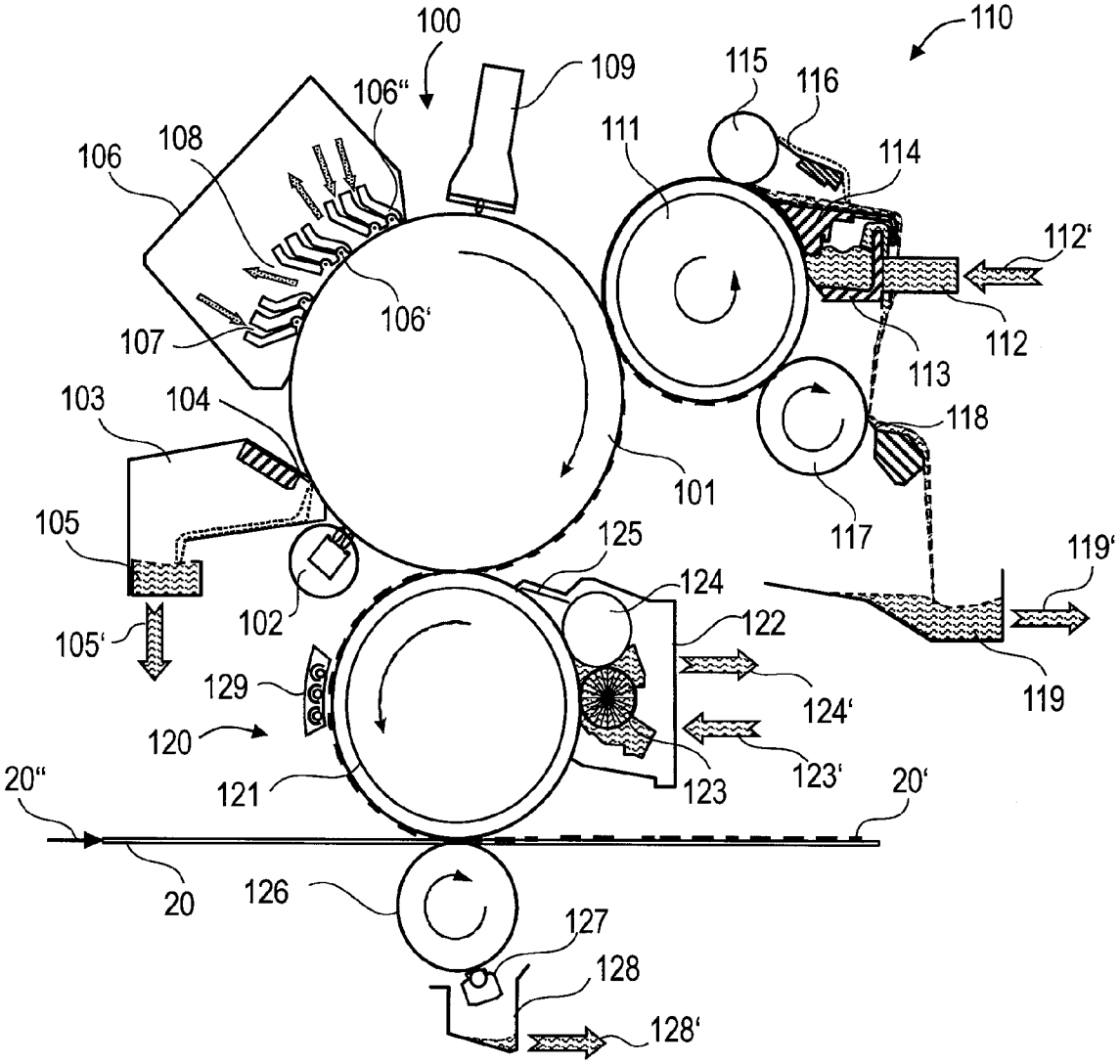
FIG. 2 shows a schematic construction of a printing unit of the digital printer according to FIG. 1.

An exemplary printing arrangement for two-sided printing is shown in FIGS. 1 and 2 by way of a digital printer, although the printing arrangement according to the invention is not limited to such digital printers.

According to FIG. 1, a digital printer 10 for printing on a recording medium 20 comprises one or more printing units 11*a*-11*d* (simplex printing apparatus 11) and 12*a*-12*d* (duplex printing apparatus) which print a toner image (print image 20'; see FIG. 2) on the recording medium 20. As recording medium 20, a recording medium 20 in web form can, as shown, be unwound from a reel 21 by an unwinder 22 and fed to the first printing unit 11*a*. The print image 20' is fixed on the recording medium 20 in a final fixing apparatus 30. The recording medium 20 can then be wound onto a reel 28 by a rewinder 27. Such a configuration is also known as a reel-to-reel printer. In order to intermediately fix the image downstream of the simplex printing apparatus 11, an intermediate fixing apparatus 29 is provided subsequent to a turning device 24, for example a cross turner, in which intermediate fixing apparatus the printed first side of the recording medium 20 is exposed to superheated steam 300.

In the preferred configuration shown in FIG. 1, the recording medium 20 in web form is printed on in full colour by four printing units 11*a* to 11*d* on the front and by four printing units 12*a* to 12*d* on the back (what is known as a 4/4 configuration).

For this purpose, the recording medium 20 is unwound from the reel 21 by the unwinder 22 and fed to the first printing unit 11*a* via an optional conditioning unit 23. In the conditioning unit 23 the recording medium 20 can be pretreated or coated with a suitable substance. In certain embodiments, high-melting wax or chemically equivalent substances can preferably be used as coating substance (also referred to as primer). However, coating the recording medium 20 is not absolutely necessary and in certain embodiments is also not preferred, since the intermediate fixing by superheated steam 300 may otherwise also result in melting of the coating substance.

The coating substance may be applied over the entire surface of the recording medium 20 or only to the areas subsequently to be printed on, in order to prepare the recording medium 20 for printing and/or to influence the absorption behaviour of the recording medium 20 upon application of the print image 20'. The subsequently applied printing material, for example toner particles or a carrier liquid, is thus prevented from penetrating into the recording medium 20 too much, and instead remains substantially on the surface (thus improving colour and image quality).

The recording medium 20 is then fed in turn to the first printing units 11*a* to 11*d*, in which only the front is printed on. Each printing unit 11*a*-11*d* usually prints on the recording medium 20 in a different colour or else with a different toner material, for example MICR toner, which can be read electromagnetically.

After the printing on the front, the recording medium 20 is turned in a turning device 24, intermediately fixed by the intermediate fixing apparatus 29 and fed to the remaining printing units 12*a*-12*d* for printing on the back. The intermediate fixing prepares the recording medium 20 for back printing and prevents the front print image from being damaged mechanically during further transport through the subsequent printing units.

In order to achieve full-colour printing, at least four colours (and thus at least four printing units 11, 12) are required, and specifically for example the basic colours YMCK (yellow, magenta, cyan and key). Further printing units 11, 12 using special colours (for example, client-specific colours or additional basic colours, in order to extend the printable colour space) can also be used.

A register unit 25 is arranged downstream of the printing unit 12*d* and evaluates register marks which are printed on the recording medium 20 independently of the print image 20' (in particular outside the print image 20'). The transverse and longitudinal register (the basic colour dots which form a colour dot should be arranged on top of one another or spatially very close to one another; this is also known as colour register or four-colour register) and the register (front and back must coincide precisely in space) can thus be adjusted, in order to achieve a qualitatively good print image 20'.

The final fixing apparatus 30 is arranged downstream of the register unit 25 and fixes the print image 20' onto the recording medium 20. In the case of electrophoretic digital printers, a thermal dryer, for example, which largely evaporates the carrier liquid so that only the toner particles remain on the recording medium 20, is used as a final fixing apparatus 30. This happens under the effect of heat. In this connection, the toner particles may also be melted onto the recording medium 20 if they comprise a material which is meltable under the effect of heat, for example resin. In preferred embodiments, fixing may also take place using superheated steam, and this can have advantages with regard to the costs and/or the print quality, in particular when using hygrophilic or moisture-containing recording media (20).

A draw unit 26 is arranged downstream of the final fixing apparatus 30 and draws the recording medium 20 through all the printing units 11*a*-12*d* and the final fixing apparatus 30 without a further drive being arranged in this region, as a friction drive for the recording medium 20 would involve the risk of blurring the as yet unfixed print image 20'.

The draw unit 26 feeds the recording medium 20 to the rewinder 27, which rolls up the printed recording medium 20.

Arranged centrally next to the printing units 11, 12 and the final fixing apparatus 30 are all the supply apparatuses for the digital printer 10, such as air conditioning modules 40, power supply 50, controller 60, liquid management modules 70, such as liquid control unit 71 and reservoirs 72 for the various liquids. In particular, pure carrier liquid, highly concentrated liquid developer (high toner particle content in relation to the carrier liquid) and serum (liquid developer plus charge control agents) as well as water for the intermediate fixing apparatus 29 and optionally the final fixing apparatus 30 can be used as liquids for supplying the digital printer 10. Waste containers for liquids to be disposed of or containers for cleaning liquid are also provided.

The digital printer 10 with its identically constructed printing units 11, 12 is constructed in a modular manner. The printing units 11, 12 do not differ mechanically but merely in terms of the liquid developer contained therein (toner colour or toner type).

The basic construction of a printing unit 11, 12 is shown in FIG. 2. Such a printing unit is based on the electrophotographic principle by which a photoelectric image carrier is inked with charged toner particles by a liquid developer and the resulting image is transferred to the recording medium 20.

The printing unit 11, 12 basically consists of an electrophotography station 100, a developer station 110 and a transfer station 120.

At the core of the electrophotography station 100 is a photoelectric image carrier which comprises a photoelectric layer (known as a photoconductor) at its surface. In this case, the photoconductor is designed as a roller (photoconductor roller 101) and has a hard surface. The photoconductor roller 101 rotates past the various elements to produce a print image 20' (rotation in the direction of the arrow).

The photoconductor is firstly cleaned of all impurities. For this purpose, an erasing light 102 is provided which erases the charges remaining on the surface of the photoconductor. The erasing light 102 is adjustable (locally variable) in order to achieve a homogeneous light distribution. The surface can thus be pretreated uniformly.

After the erasing light 102, a cleaning apparatus 103 cleans the photoconductor mechanically in order to remove toner particles which may still present on the surface of the photoconductor, possibly dirt particles and remaining carrier liquid. The carrier liquid which is cleaned off is fed to a collecting container 105. The collected carrier liquid and toner particles are processed (optionally filtered) and, depending on colour, fed to a corresponding liquid ink supply, that is to say one of the reservoirs 72 (cf. arrow 105').

The cleaning apparatus 103 preferably comprises a blade 104 which rests at an acute angle (approximately 10° to 80° to the delivery surface) against the outer face of the photoconductor roller 101 in order to clean the surface mechanically. The blade 104 can move back and forth at right angles to the direction of rotation of the photoconductor roller 101 in order to clean the outer face over the entire axial length with as little wear as possible.

The photoconductor is then charged at a predetermined electrostatic potential by a charging device 106. A plurality of corotrons (in particular glass-clad corotrons) is preferably provided for this purpose. The corotrons consist of at least a wire 106' to which a high voltage is applied. The voltage ionises the air around the wire 106'. A screen 106" is provided as a counter electrode. Fresh air which is supplied through special air ducts (air supply duct 107 for aeration and exhaust air duct 108 for venting) between the screens (see also air flow arrows in FIG. 2) also flows around the corotrons. The supplied air is then ionised uniformly at the wire 106'. As a result, homogeneous, uniform charging of the adjacent surface of the photoconductor is achieved. The uniform charging can be improved further by using dry and heated air. Air is removed via the exhaust air ducts 108. Any resulting ozone can also be drawn off via the exhaust air ducts 108.

The corotrons are cascadable, that is to say there are two or more wires 106' per screen 106" at the same screen voltage. The current which flows across the screen 106" is variable and the charging of the photoconductor is thus controllable. Current can flow through the corotrons at different strengths in order to achieve uniform and sufficiently high charging of the photoconductor.

A character generator 109 is arranged downstream of the charging device 106 and discharges the photoconductor pixel by pixel via optical radiation according to the desired print image 20'. This results in a latent image which is subsequently inked with toner particles (the inked image corresponds to the print image 20'). Preferably, an LED character generator 109 is used in which an LED row comprising many individual LEDs is arranged in a stationary manner over the entire axial length of the photoconductor roller 101. The number of LEDs and the size of the optical imaging points on the photoconductor determine inter alia the resolution of the print image 20' (typical resolution is 600×600 dpi). The LEDs can be controlled individually in time and in terms of their radiant power. Thus, multilevel methods can be used to produce dots (consisting of a plurality of picture elements or pixels) or picture elements can be delayed in order to carry out corrections electro-optically, for example in the case of incorrect colour register or register.

The character generator 109 comprises a drive logic which must be cooled owing to the large number of LEDs and the radiant power thereof. The character generator 109 is preferably liquid-cooled. The LEDs can be driven in groups (a plurality of LEDs combined to form a group) or separately from one another.

The latent image produced by the character generator 109 is inked with toner particles by the developer station 110. For this purpose, the developer station 110 comprises a rotating developer roller 111 which introduces a layer of liquid developer onto the photoconductor (the mode of operation of the developer station 110 will be described in detail below). Since the surface of the photoconductor roller 101 is relatively hard, the surface of the developer roller 111 is relatively soft and the two are pressed against one another, a thin, tall nip (a gap between the rollers) is produced, in which the charged toner particles migrate electrophoretically from the developer roller 111 to the photoconductor in the image areas owing to an electric field. In the non-image areas, no toner passes onto the photoconductor. The nip filled with liquid developer has a height (thickness of the gap) which is dependent on the mutual pressure of the two rollers 101, 111 and the viscosity of the liquid developer. The thickness of the nip is typically in the range from greater than approximately 2 μm to approximately 20 μm (the values can also vary depending on the viscosity of the liquid developer). The length of the nip is approximately a few millimeters.

The inked image rotates with the photoconductor roller 111 to a first transfer point in which the inked image is transferred substantially completely onto a transfer roller 121. At the first transfer point (nip between photoconductor roller 101 and transfer roller 121), the transfer roller 121 moves in the same direction as and preferably at an identical speed to the photoconductor roller 101. After the transfer of the print image 20' onto the transfer roller 121, the print image 20' (toner particles) can optionally be recharged or charged by a charging unit 129, for example a corotron, in order for the toner particles to be transferred better onto the recording medium 20 afterwards.

The recording medium 20 passes in the transport direction 20" between the transfer roller 121 and an impression roller 126. The contact region (nip) represents a second transfer point where the toner image is transferred onto the recording medium 20. In the second transfer region, the transfer roller 121 moves in the same direction as the recording medium 20. The impression roller 126 also rotates in this direction in the region of the nip. The speeds of the transfer roller 121, the impression roller 126 and the recording medium 20 are coordinated and preferably identical at the transfer point, in order not to smudge the print image 20'. At the second transfer point, the print image 20' is transferred onto the recording medium 20 electrophoretically owing to an electric field between the transfer roller 121 and the impression roller 126. Moreover, the impression roller 126 presses against the relatively soft transfer roller 121 with a large mechanical force, whereby the toner particles also stick to the recording medium 20 owing to adhesion.

Since the surface of the transfer roller 121 is relatively soft and the surface of the impression roller 126 is relatively hard, upon rolling a nip is produced in which the toner transfer takes place. Unevennesses of the recording medium 20 can thus be compensated, such that the recording medium 20 can be printed on without gaps. Such a nip is also well suited for printing on relatively thick or relatively uneven recording media 20, as is the case for example in packaging printing.

Although the print image 20' should pass completely onto the recording medium 20, a few toner particles may undesirably remain on the transfer roller 121. Some of the transfer liquid always remains on the transfer roller 121 owing to the crosslinking. The toner particles which may remain should be removed virtually completely by a cleaning unit 122 downstream of the second transfer point. The carrier liquid remaining on the transfer roller 121 can also be removed from the transfer roller 121 completely or to a predetermined layer thickness in order that, downstream of the cleaning unit 122 and upstream of the first transfer point from the photoconductor roller 101 onto the transfer roller 121, the same conditions prevail owing to a clean surface or a defined layer thickness of liquid developer on the surface of the transfer roller 121.

This cleaning unit 122 is preferably designed as a wet chamber comprising a cleaning brush 123 and a cleaning roller 124. In the region of the brush 123, cleaning liquid (for example, carrier liquid or a separate cleaning liquid can be used) is supplied via a cleaning liquid inlet 123'. The cleaning brush 123 rotates in the cleaning liquid and "brushes" the surface of the transfer roller 121. The toner adhering to the surface is loosened as a result.

The cleaning roller 124 is at an electrical potential which is opposed to the charge of the toner particles. As a result, the electrically charged toner is removed from the transfer roller 121 by the cleaning roller 124. Since the cleaning roller 124 touches the transfer roller 121, it also removes carrier liquid remaining on the transfer roller 121 together with the supplied cleaning liquid. A conditioning element 125 is arranged at the outlet of the wet chamber. As shown, a retaining plate which is arranged at an obtuse angle (for example between 100° and 170° between plate and delivery surface) to the transfer roller 121 can be used as a conditioning element 125, whereby residues of liquid on the surface of the roller in the wet chamber are held back virtually completely and fed to the cleaning roller 124 for removal via a cleaning liquid drain 124' to a cleaning liquid reservoir (not shown, among the reservoirs 72).

Instead of the retaining plate, a metering unit (not shown), which for example comprises one or more metering rollers, can also be arranged there. The metering rollers are at a predetermined distance from the transfer roller 121 and remove a quantity of carrier liquid such that a predetermined layer thickness is set downstream of the metering rollers owing to the squeezing. The surface of the transfer roller 121 is then not completely cleaned; carrier liquid remains over the entire surface to a predetermined layer thickness. Removed carrier liquid is recycled to the cleaning liquid reservoir via the cleaning roller 124.

The cleaning roller 124 itself is kept clean mechanically by a blade (not shown). Cleaned-off liquid, including toner particles, is collected for all colours by a central collecting container, cleaned and fed to the central cleaning liquid reservoir for recycling.

The impression roller 126 is also cleaned by a cleaning unit 127. As a cleaning unit 127, a blade, a brush and/or a roller can remove impurities (paper dust, toner particle residue, liquid developer, etc.) from the impression roller 126. The cleaned liquid is collected in a collecting container 128 and supplied to the printing process again via a liquid drain 128', optionally in a cleaned state. The cleaning can be done dry or by washing liquid (carrier/serum).

In the printing units 11 which print on the front of the recording medium 20, the impression roller 126 presses against the unprinted side (and thus the side which is still dry) of the recording medium 20.

Nevertheless, there may be dust/paper particles or other dirt particles on the dry side which are then removed by the impression roller 126. For this purpose, the impression roller 126 should be wider than the recording medium 20. As a result, impurities outside the print region can also be cleaned off effectively.

In the printing units 12 which print on the back of the recording medium 20, the impression roller 126 presses directly on the damp print image 20' of the front, which has not yet been fixed. In order for the print image 20' not to be removed by the impression roller 126, the surface of the impression roller 126 can in certain embodiments have non-stick properties with regard to toner particles and also with regard to the carrier liquid on the recording medium 20.

The developer station 110 inks the latent print image 20' with a predetermined toner. For this purpose, the developer roller 111 introduces toner particles onto the photoconductor. In order to ink the developer roller 111 itself with an all-over layer, liquid developer is firstly fed in a predetermined concentration from a mixing container (not shown, inside the liquid control unit 71) to a supply chamber 112 via a liquid inlet 112'. From this supply chamber 112, the liquid developer is fed in abundance to an antechamber 113 (a type of upwardly open trough). An electrode segment 114 is arranged towards the developer roller 111 and forms a gap between itself and the developer roller 111.

The developer roller 111 rotates through the upwardly open antechamber 113 and carries liquid developer along into the gap. Excess liquid developer passes from the antechamber 113 back to the supply chamber 112.

Owing to the electric field formed between the electrode segment 114 and the developer roller 111 owing to the electrical potentials, the liquid developer in the gap is distributed into two regions, specifically a layer region in the vicinity of the developer roller 111, in which layer region the toner particles are concentrated (concentrated liquid developer), and a second region in the vicinity of the electrode segment 114, which second region is depleted in toner particles (very low-concentration liquid developer).

The layer of liquid developer is then transported on to a metering roller 115. The metering roller 115 squeezes off the upper layer of liquid developer, such that a defined layer thickness of liquid developer of approximately 5 μm thickness remains on the developer roller 111 afterwards. Since the toner particles are located mainly near the surface of the developer roller 111 in the carrier liquid, mainly the carrier liquid on the outside is squeezed off or retained and ultimately recycled to a collecting container 119, but not fed to the supply chamber 112.

As a result, predominantly high-concentration liquid developer is conveyed through the nip between metering roller 115 and developer roller 111. A uniformly thick layer of liquid developer comprising approximately 40 percent by mass toner particles and approximately 60 percent by mass carrier liquid is thus formed downstream of the metering roller 115 (depending on the printing process requirements, the mass ratios may also fluctuate to a greater or lesser extent). This uniform layer of liquid developer is transported into the nip between the developer roller 111 and the photoconductor roller 101. There, the image areas of the latent image are then inked electrophoretically with toner particles, while no toner passes onto the photoconductor in the region of non-image areas. Enough carrier liquid is imperative for electrophoresis. Downstream of the nip the liquid film splits approximately in the middle owing to wetting, such that part of the layer sticks to the surface of the photoconductor roller 101 and the other part (for image areas mainly carrier liquid and for non-image areas toner particles and carrier liquid) remains on the developer roller 111.

In order that the developer roller 111 can be coated with liquid developer again under the same conditions and uniformly, remaining toner particles (these basically represent the negative, non-transferred print image) and liquid developer are removed electrostatically and mechanically by a cleaning roller 117. The cleaning roller 117 itself is cleaned by a blade 118. The cleaned-off liquid developer is fed to the collecting container 119 for recycling, the liquid developer cleaned from the metering roller 115, for example by a blade 116, and the liquid developer cleaned from the photoconductor roller 101 by the blade 104 also being fed to said collecting container 119.

The liquid developer collected in the collecting container 119 is fed to the mixing container via the liquid drain 119'. Fresh liquid developer and pure carrier liquid are also fed to the mixing container as required. There must always be enough liquid in a desired concentration (predetermined ratio of toner particles to carrier liquid) in the mixing container. The concentration is continuously measured in the mixing container and adjusted in accordance with the supply of the amount of cleaned-off liquid developer and the concentration thereof and the amount and concentration of fresh liquid developer and carrier liquid.

For this purpose, maximum-concentration liquid developer, pure carrier liquid, serum (carrier liquid and charge control agents for controlling the charge of the toner particles) and cleaned-off liquid developer can be fed separately to this mixing container from the corresponding reservoirs 72.

The photoconductor can preferably be designed in the form of a roller or as an endless loop. An amorphous silicon as photoconductor material or an organic photoconductor material (also known as OPC) can be used.

Instead of a photoconductor, other image carriers, such as magnetic, ionisable, etc. image carriers, can also be used which do not operate according to the photoelectric principle but rather on which latent images are impressed electrically, magnetically or in another manner according to other principles and then inked and finally transferred onto the recording medium 20.

LED rows or lasers having corresponding scan mechanics can be used as a character generator 109.

The transfer element can also be designed as a roller or as an endless loop. The transfer element can also be omitted. The print image 20' is then transferred directly from the photoconductor roller 101 onto the recording medium 20.

The term "electrophoresis" is understood to mean the migration of the charged toner particles in the carrier liquid owing to the effect of an electric field. Upon each transfer of toner particles, the corresponding toner particles pass substantially completely onto another element. After contacting of the two elements, the liquid film is split approximately in half owing to the wetting of the elements involved, such that approximately half sticks to the first element and remainder sticks to the other element. The print image 20' is transferred and then transported on in the next part in order to allow electrophoretic migration of the toner particles again in the next transfer region.

The digital printer 10 can comprise one or more printing units for the front printing and optionally one or more printing units for the back printing. The printing units can be arranged in a line, in an L shape or in a U shape.

Instead of the rewinder 27, finishing apparatuses (not shown) such as cutters, folders, stackers, etc. can also be arranged downstream of the draw unit 26 in order to bring the recording medium 20 into the final form. For example, the recording medium 20 could be processed to the extent that a finished book is produced at the end. The finishing equipment could also be arranged in line or offset therefrom.

As described above as a preferred embodiment, the digital printer 10 can be operated as a reel-to-reel printer. It is also possible to cut the recording medium 20 into sheets at the end and then to stack the sheets or process them in a suitable manner (reel-to-sheet printer). It is also possible to feed a recording medium 20 in sheet form to the digital printer 10 and to stack or process the sheets at the end (sheet-to-sheet printer).

Depending on the desired print image 20' on the front and back (duplex printing), the printer configuration includes a corresponding number of printing units for front and back, each printing unit 11, 12 always being set up only for one colour or one type of toner.

The maximum number of printing units 11, 12 is only technically limited by the maximum mechanical tensile loading of the recording medium 20 and the free gauge length. Typically, any desired configurations are possible, from a 1/0 configuration (only one printing unit for the front to be printed on) up to a 6/6 configuration, in which six printing units are provided for the front and six for the back of the recording medium 20. The preferred embodiment (configuration) is shown in FIG. 1 (a 4/4 configuration), with which full-colour printing is executed for the front and the back using the four basic colours. The sequence of printing units 11, 12 in four-colour printing preferably goes from a printing unit 11, 12 which prints light (yellow) to a printing unit 11, 12 which prints dark, that is to say for example the recording medium 20 is printed on from light to dark in the colour sequence Y-C-M-K.

The recording medium 20 can be made of paper, metal, plastics material or other suitable materials which can be printed on.

Figure 3:
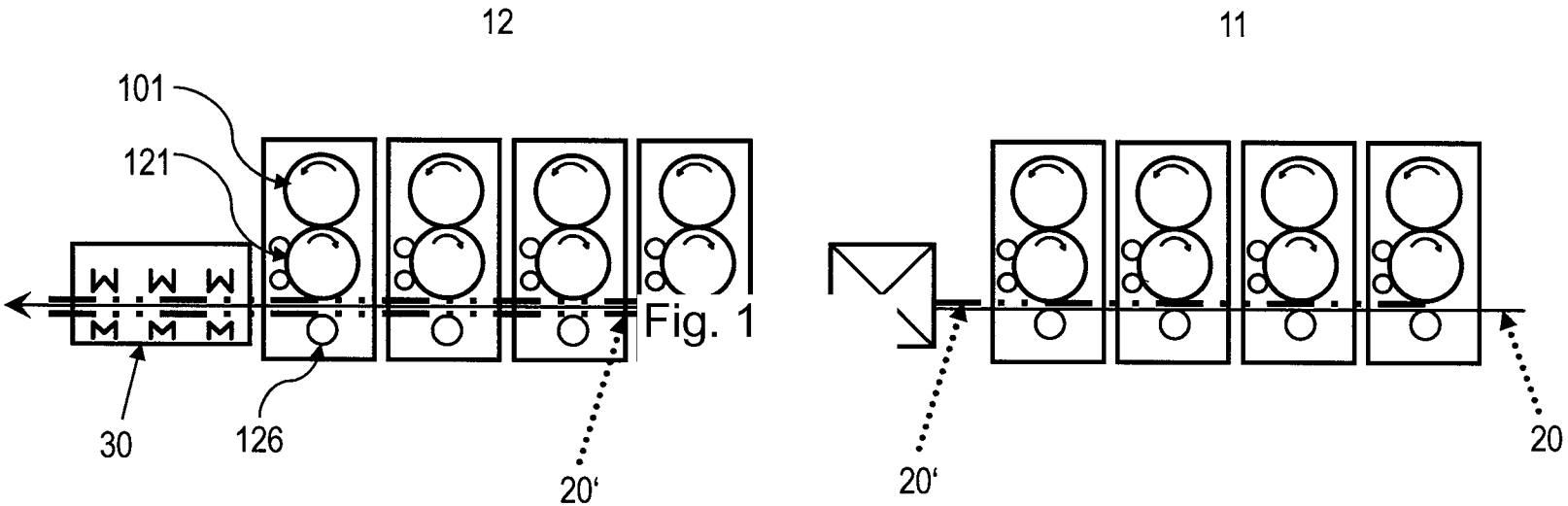
FIG. 3 shows a schematic construction of the digital printer according to FIG. 1.

A simpler view of the simplex printing apparatus 11, the duplex printing apparatus 12, the turning device 24 and the intermediate fixing apparatus 29 is shown schematically in FIG. 3, the recording medium 20 being fed into the printing arrangement from right to left.

FIG. 3 shows an embodiment of the present printing arrangement for two-sided printing in which the intermediate fixing by superheated steam 300 takes place downstream of the turning device 24. However, it is not impossible for the intermediate fixing to take place upstream of the turning device 24 subsequent to the simplex printing apparatus 11 or inside the turning device. However, it is preferred if the intermediate fixing does not take place in the turning device 24, that is to say takes place either between the simplex printing apparatus 24 and the turning device 24 or between the turning device 24 and the duplex printing apparatus 12, since the intermediate fixing apparatus 29 can then be inserted easily between the respective devices without retrofitting of the turning device 24 being necessary. In this way it is also easier to monitor the amount of moisture applied to the recording medium 20 by the superheated steam 300. FIG. 3 also shows the application of the printing material onto the respective sides of the recording medium 20 in the simplex printing apparatus 11 and onto the second side in the duplex printing apparatus 12. The preferred intermediate fixing of the simplex print image by an intermediate fixing apparatus 29, which faces the printed side of the recording medium 20 downstream of the simplex printing apparatus 11 and the turning device 24, can also be seen. Intermediate fixing by a direct application of the superheated steam 300 on the printed side of the recording medium is thus preferred.

Figure 4:
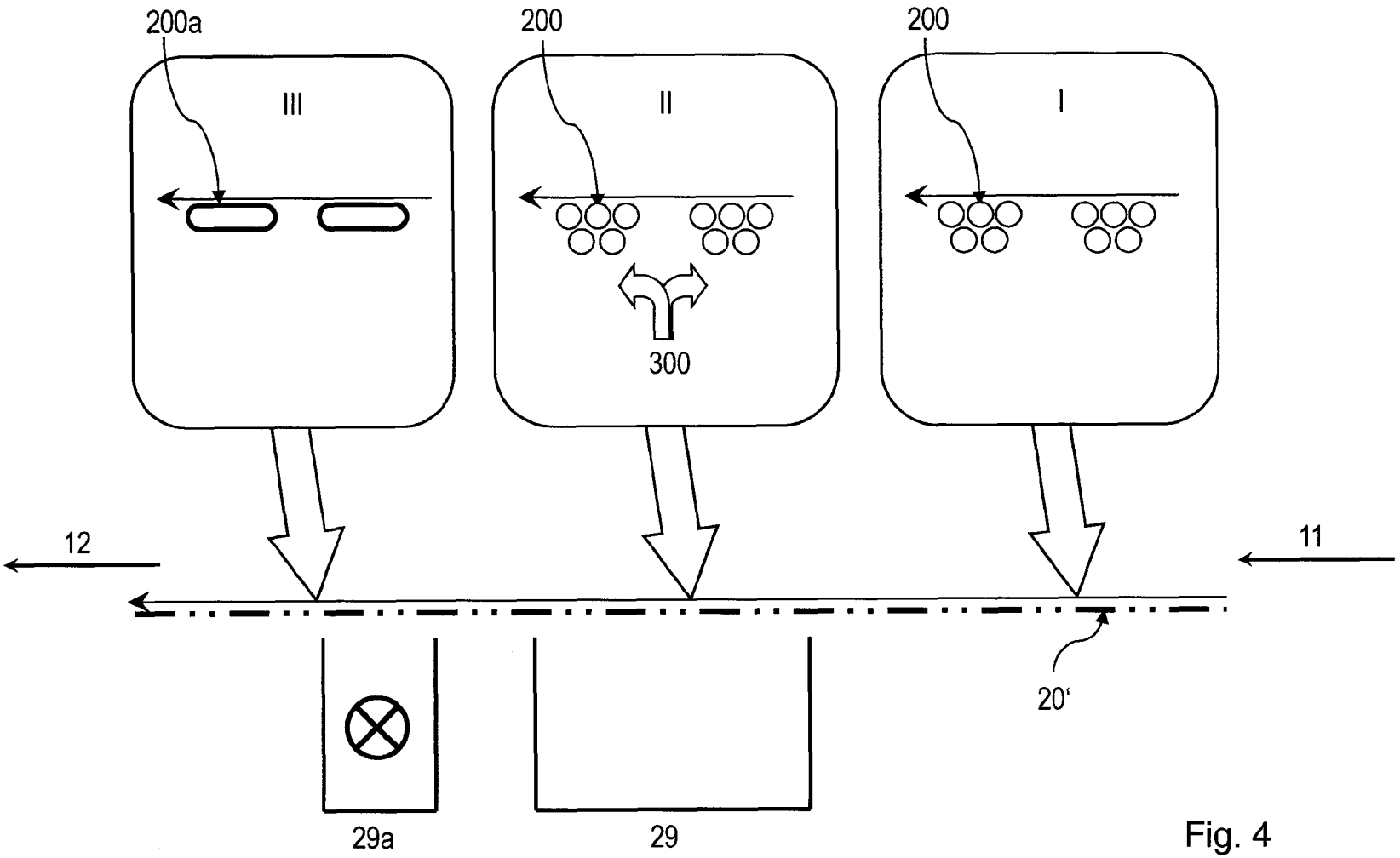
FIG. 4 is a schematic detailed view of the intermediate fixing in a printing arrangement according to the invention.

FIG. 4 shows schematically the intermediate fixing by the superheated steam 300. FIG. 4 shows in detail the application of the superheated steam onto the printing material and the subsequent intermediate fixing of the printing material, the recording medium 20 being conveyed from right to left in FIG. 4, too.

According to FIG. 4, after the simplex printing in the simplex printing apparatus 11, the printing material is on the underside of the recording medium 20, for example downstream of a turning device 24, and is brought to the intermediate fixing apparatus 29.

In phase I, the not yet intermediately fixed printing material can be seen, which here is represented by way of example by a printing material 200 in the form of particles. The printing material 200 can be in any form of particles, for example printing material particles or toner particles, or in the form of liquid printing material, provided that in the liquid printing material, after removal of the carrier liquid at least in part, there is a material which can be partially sintered/bonded by superheated steam. In phase II, the superheated steam 300 is applied from the intermediate fixing apparatus 29. In phase III, cooling (optional according to the invention) takes place by a cooling apparatus 29*a*. The printing material 200 is sintered at least in part by the superheated steam 300, that is to say the printing material 200 partially melts and sticks together/bonds, resulting in intermediate fixing. During intermediate fixing, contacts are formed between the individual printing material particles 200 owing to the partial melting, complete melting of the printing material 200 and adhesion of the printing material 200 to the recording medium 20 being omitted in certain embodiments. A partially fixed printing material 200*a* is produced on the recording medium 20 and does not stick to the recording medium 20 after intermediate fixing in certain embodiments. In particular, there is no homogeneously melted layer of printing material on the recording medium 20.

In certain embodiments, the superheated steam 300 is supplied only on the first side, provided with printing material, of the recording medium 20, in order to ensure intermediate fixing of the printing material.

In certain embodiments, it is also possible for example to control the application of the superheated steam 300 onto the printing material in a targeted manner. Thus, for example in the case of narrow papers or print images, the amount of steam can be reduced by controlling, by screens, closable nozzles or the like, the region in which the superheated steam 300 is applied.

The cooling by the cooling apparatus 29*a* can take place on one or the two sides of the recording medium 20, it being preferred in certain embodiments to cool from the two sides in order to avoid a temperature gradient occurring at the recording medium.

The recording medium 20 is subsequently fed to the duplex printing apparatus 12 for printing on the second side of the recording medium.

Figure 5:
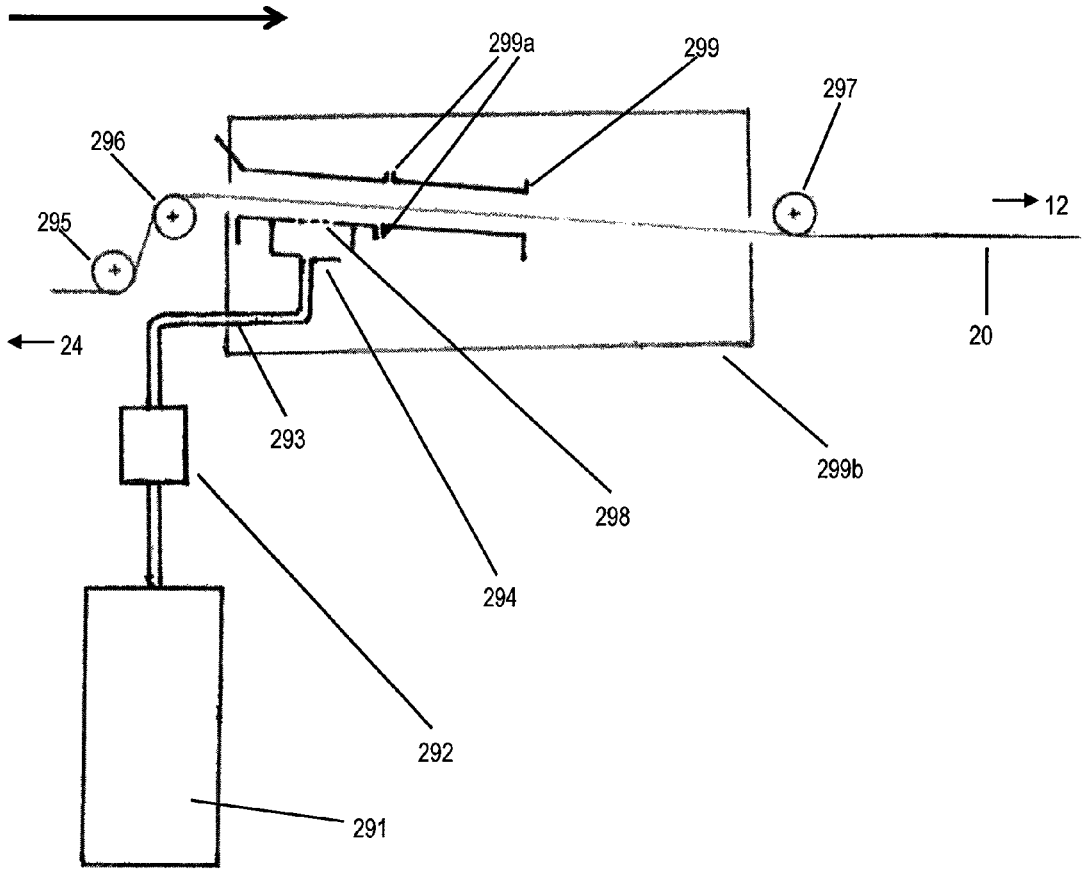
FIG. 5 shows an exemplary arrangement of an intermediate fixing apparatus according to the invention.

An exemplary intermediate fixing apparatus 29 is shown in FIG. 5 together with further components of the printing arrangement. According to this figure, the recording medium 20 is fed from left to right. In this case, the intermediate fixing apparatus comprises a steam generator 291, a cyclone separator 292, a steam inlet 293 (for example a hose fitting), a steam distributor 294, a perforated plate 298 and a shaft 299 comprising steam outlet openings 299*a* in a housing 299*b*. However, superheated steam 300 can for example also be supplied to the recording medium 20 in another manner, for example via a plurality of nozzles or microporous elements. The superheated steam 300 can also come from other sources, and for example a cyclone separator 292 is not absolutely necessary. In the intermediate fixing apparatus 29 in FIG. 5, the superheated steam 300 is generated in the steam generator 291. Any included drops of water/condensation nuclei are removed in the cyclone separator 292 in order for the superheated steam 300 to be free from these. By suitable measures, however, in certain embodiments it can also be ensured that there are no condensation nuclei or drops of water in the superheated steam 300, such that a cyclone separator 292 is not necessary. However, it is advantageous for there to be no drops of water or condensation nuclei in the superheated steam 300, in order to avoid excessive moistening of the recording medium 20.

In certain embodiments the superheated steam 300 can be generated for example according to the entropy diagram (T-S diagram) by 1. Pressure increase: isentropic (entropy s=constant);
2. Heating and evaporation: isobaric (pressure p=constant) and during evaporation isobaric, isothermic (p, T=constant); and
3. Throttling to ambient pressure (efficiency q=0%): isenthalpic (enthalpy h=constant), in order to ensure superheating of the superheated steam. However, expansion of the superheated steam should in this case take place only a short distance before the recording medium 20, for example a short distance before the perforated plate 298, in order that the superheated steam 300 can be applied to the recording medium 20 at sufficient pressure.

Examples of the theoretical overpressure can be found in Table 1 below (http://webbook.nist.gov/chemistry/fluid).

TABLE 1

Thermodynamic data for the overpressure of the superheated steam

| Overpressure (bar) | T_steam (° C.) | H" (kJ/kg) | T_throttled (° C.) | S_throttled (kJ/kg K) |
|---|---|---|---|---|
| 0 | 99.2 | 2675 | 99.2 | 7.3483 |
| 1 | 120.2 | 2706 | 115 | 7.4266 |
| 2 | 133.5 | 2724 | 124 | 7.4730 |
| 3 | 143.6 | 2738 | 131 | 7.5081 |
| 4 | 151.8 | 2747 | 135 | 7.5278 |

The superheated steam 300 is fed to the steam distributor 294 by the steam inlet 293, the superheated steam 300 being distributed in a controlled manner via a perforated plate 298. However, the supply and distribution can take place in another suitable manner, for example via nozzles or individual supply ducts. The superheated steam 300 is preferably applied in the form of a steam jet which is comparable with an air knife, the superheated steam 300 then being carried along with the recording medium 20 owing to the speed of movement thereof. To facilitate application onto the recording medium 20, this can take place for example in a shaft 299 comprising steam outlet openings 299*a*, such that a constant steam atmosphere can be maintained and there are no or only slight variations in the temperature of the superheated steam 300 and at the recording medium 20. The steam outlet openings can also ensure that excess moisture does not remain on the recording medium 20. To further ensure this steam atmosphere, the shaft 299 can also be arranged in a housing 299*b*. This can also be regarded as a buffer in relation to the surroundings. By maintaining a relatively constant temperature in the intermediate fixing apparatus 29, it can also be ensured that a temperature gradient does not occur, or occurs only to a small degree, at or in the recording medium 20.

As shown in FIG. 5, the recording medium 20 can be fed to the intermediate fixing apparatus 29 and conveyed on after the intermediate fixing, for example via web guide rollers 295/297 and microporous rods 296. The use of microporous rods, in which it is possible to convey the recording medium on in a contactless manner by applying for example compressed air from the inside out, is advantageous in particular when deflecting a side which is provided with an unfixed print image, for example the first side, of a recording medium 20.

In certain embodiments, it is also possible to provide a supply of hot air or another hot gas, which is mixed with the superheated steam 300 in order to ensure a certain moisture on the recording medium. In this connection, when the supply of superheated steam 300 and hot air or hot gas is set appropriately, it is possible to ensure, in particular in the case of moisture-containing or hygrophilic recording media 20 such as paper or cardboard, that there is neither dehumidification (drying out) nor moistening of the recording medium. Thus, no moisture gradient is produced between the recording medium 20 and the superheated steam/hot air medium.

The superheated steam 300 is preferably applied over a certain path for a certain time period in order to ensure that the printing material 200 is sintered in part. In certain embodiments, the intermediate fixing takes place for a period of less than two seconds, preferably less than 1.5 seconds, and more preferably for 1 second or less.

Furthermore, in certain embodiments it is preferred for the superheated steam 300 to be applied towards the recording medium 20 from the intermediate fixing apparatus 29 at a pressure which is higher than the ambient pressure.

Therefore, in preferred embodiments a compression device is provided in the intermediate fixing apparatus 29, by which compression device it can be managed that the superheated steam 300 is applied to the recording medium 20 at a pressure which is higher than the ambient pressure. In preferred embodiments the superheated steam 300 can also be compressed for example in a boiler. In certain embodiments, the superheated steam 300 under overpressure is expanded just before the recording medium 20. In this connection, the ambient pressure is the prevailing pressure in the printing arrangement at the time of application of the superheated steam 300. In this connection, an exemplary compression device is a nozzle, for example a pressure nozzle, but other ways of generating an overpressure are also conceivable. Owing to application under pressure, it is achieved that, even in the case of high printing speeds, a laminar boundary film on the recording medium, which film is formed after printing by swept-along ambient air owing to the roughness of the recording medium or of the printing material, can be penetrated substantially, preferably completely, by the water droplets 300 in order that the superheated steam 300 can be applied to the printing material and interact with the printing material.

For this purpose, for example superheated steam at a temperature of up to 160° C., preferably up to 150° C., more preferably up to 145° C. and particularly preferably up to 140° C. at an overpressure of 3 to 4 bar can be generated in the intermediate fixing apparatus 29 and can be expanded upon outlet from a perforated plate 298, nozzles, etc. to a temperature of between 100° C. and 140° C., preferably between 120° C. and 135° C. A suitable preferred value is for example 130° C. for an overpressure of 3 bar. In this way, a transparent zone with superheated steam 300 can be produced for example downstream of a nozzle or a perforated plate, etc. in a range of from 50 to 100 mm, within which zone the superheated steam 300 can be applied to the recording medium 20. In this zone the superheated steam 300 can penetrate the laminar boundary film and lead to partial fixing of the printing material. In particular, superheated steam is required for penetration of the laminar boundary film in order that energy can be applied to the printing material 200 via the temperature of the steam.

The partial fixing of the printing material, as opposed to complete fixing, is clear for example from FIGS. 6 and 7.

Figure 6A:
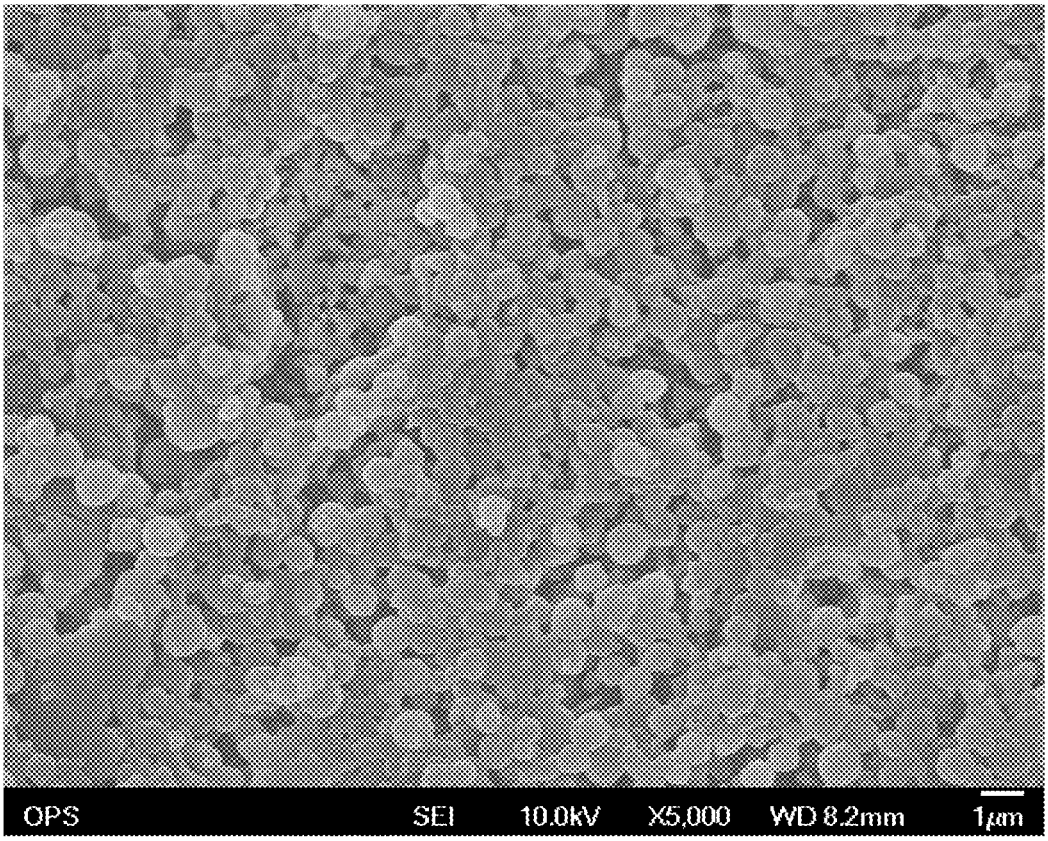
FIGS. 6*a* to 6*c* are microscopic images of intermediate fixing according to a comparative example of the present invention.
Figure 6B:
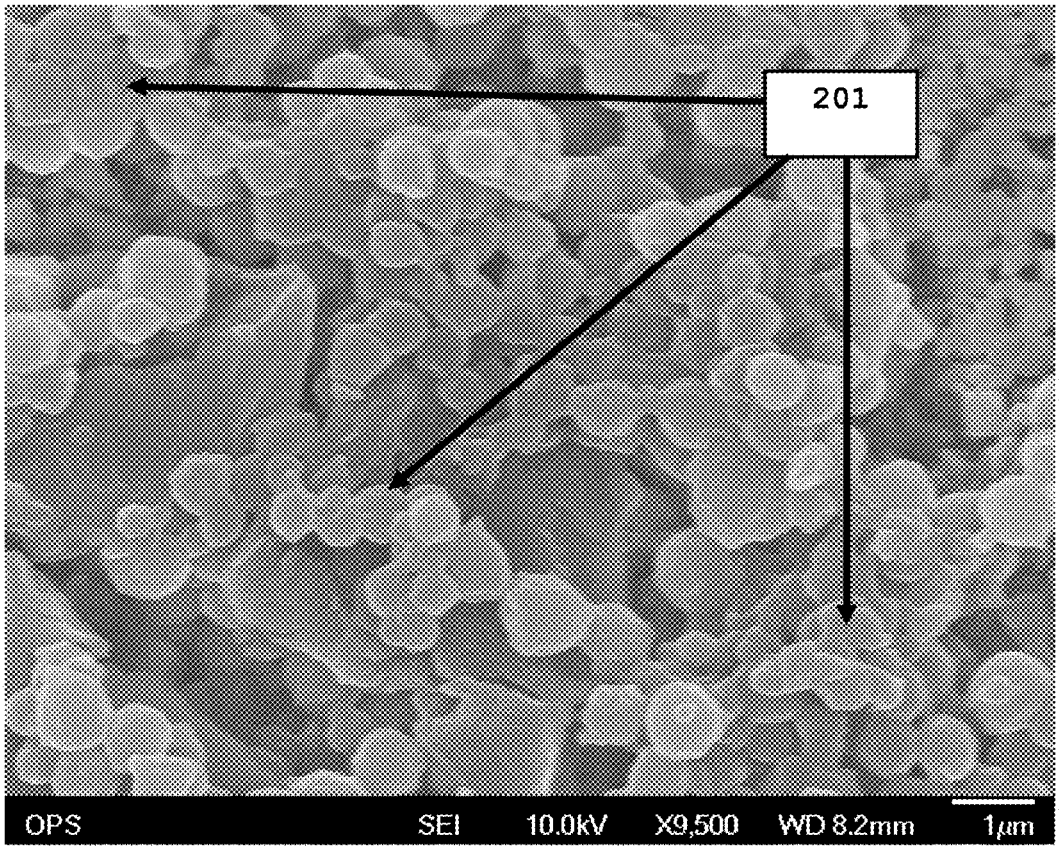
Figure 6C:
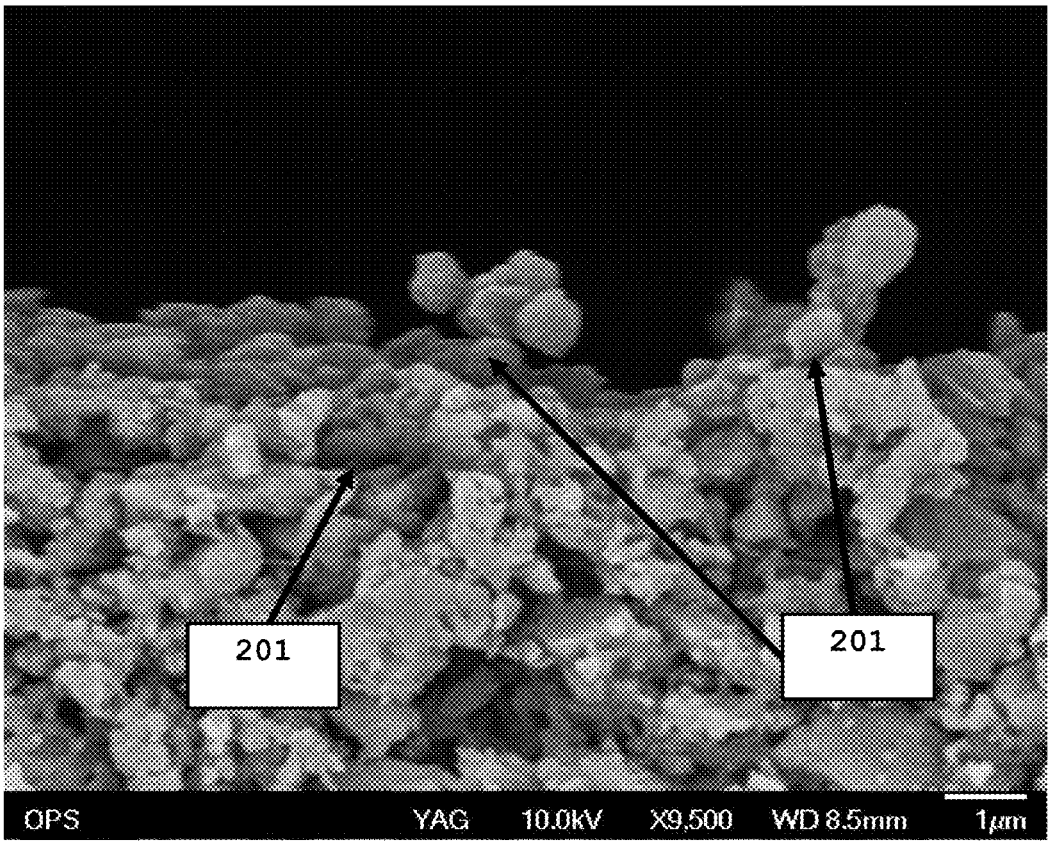

In this connection, FIG. 6 shows microscopic images of a printing material 200 according to a comparative example of the present invention, in which the printing material 200 on the recording medium 20 is sintered by treatment with infrared (IR) rays and sintering to the recording medium 20 also takes place. In this connection, Finesse Matt paper having a grammage of 115 g/m$^2$ is used as the recording medium 20, which is conveyed at 1 m/s in the duplex printing apparatus. The fixing takes place by IR rays, the back of the paper being heated to 50° C. In this connection, FIG. 6*a* shows a scanning electron microscope (SEM) image of the printing material 200 on the recording medium 20 at 5,000× magnification. Strong sintering of the printing material/a strongly sintered printing material 201 can be seen clearly. 9,500× magnification in FIG. 6*b* makes this strongly sintered printing material 201 even clearer. This can also be seen on the right in the microtome section at 9,500× magnification in FIG. 6*c*, and printing material 201*a* sintered to the recording medium 20 can also be observed in FIG. 6*c*.

Figure 7A:
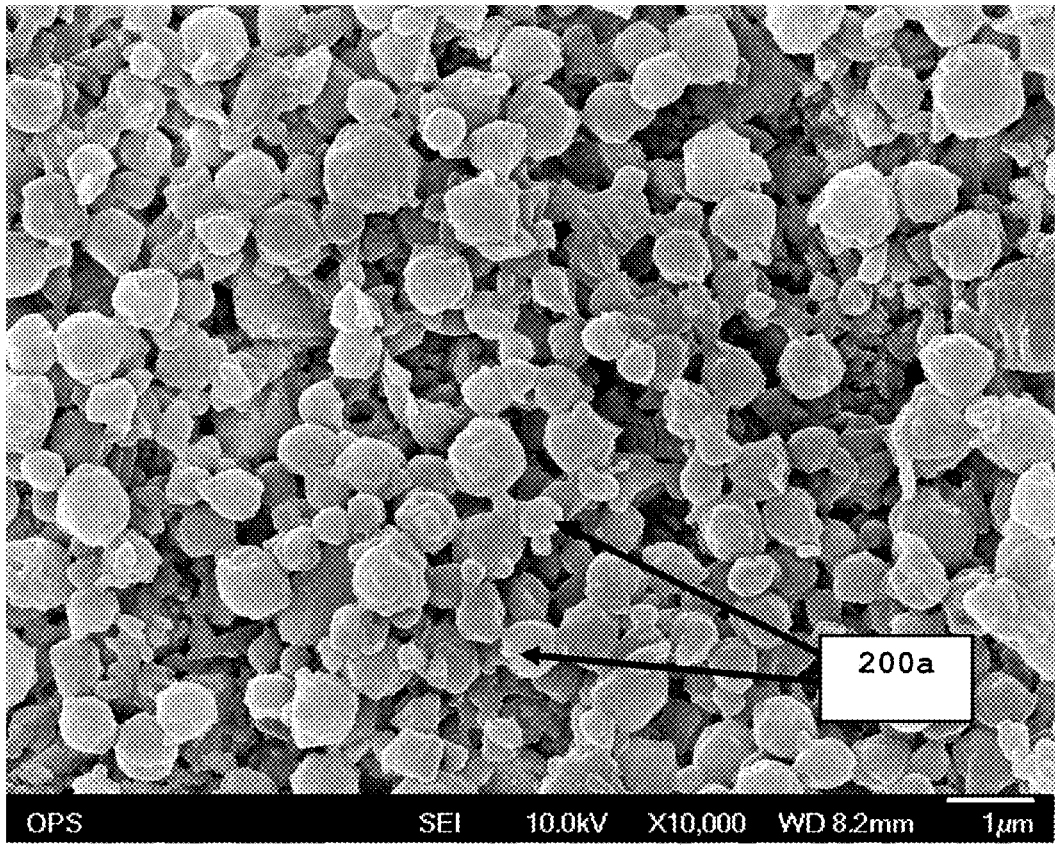
FIGS. 7*a* to 7*d* are microscopic images of intermediate fixing according to an example according to the invention.
Figure 7B:
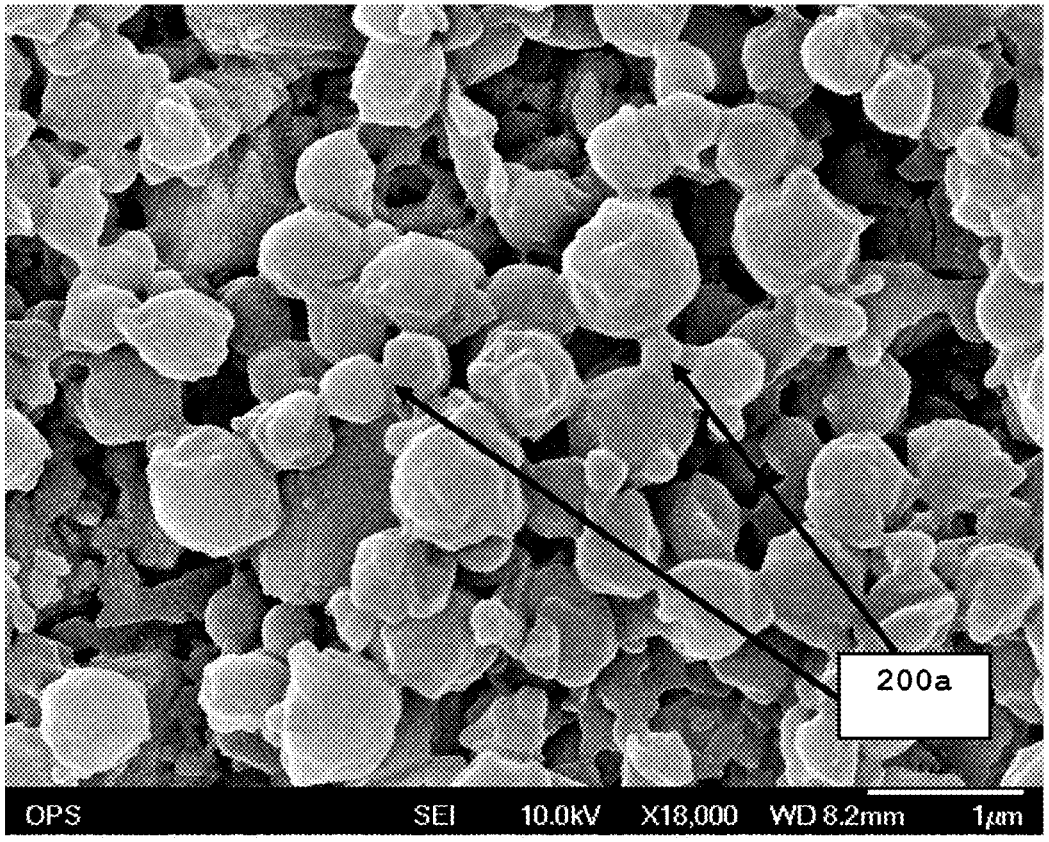
Figure 7C:
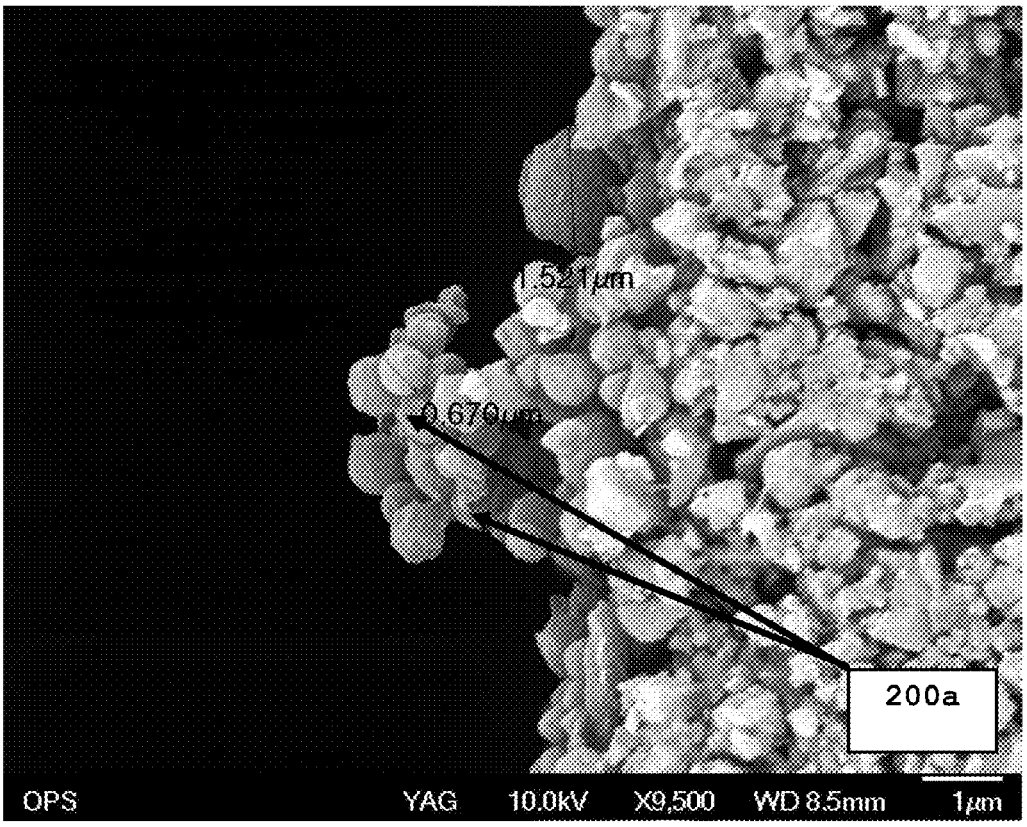
Figure 7D:
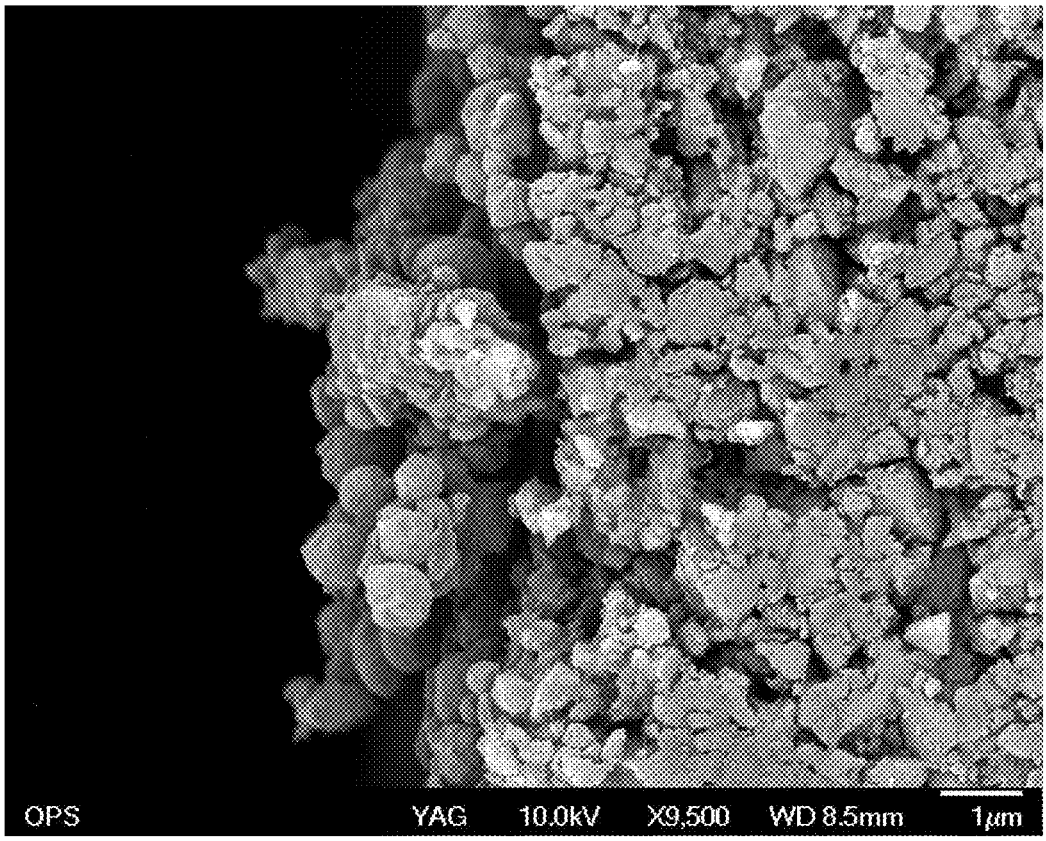

In contrast, FIG. 7*a* shows a partially fixed printing material 200*a* generated by treatment with superheated steam at 10,000× magnification, "sinter necks" between the individual printing material particles being clearly visible, that is to say thin connecting lines of printing material between the individual particles. The execution took place as in the comparative example. The paper is heated to 40° C. for a contact time of superheated steam, which is provided at 130° C. and 3 bar pressure in the intermediate fixing apparatus 29, of 1 second. The sintering necks can be seen in greater detail in FIG. 7*b*, at 18,000× magnification. The microtome section in FIG. 7*c* at 9,500× magnification also shows the sinter necks clearly, it also being clear that the printing material particles 200 in the centre are not sintered to the material of the recording medium 20 on the right-hand side. This is also clear in particular from FIG. 7*d*, which was also taken at 9,500× magnification.

In preferred embodiments, via the partial fixing/intermediate fixing of the printing material 200, a continuous area of printing material 200 is thus formed which results in mechanical stabilisation of the printing material 200. The partial bonding of the printing material 200 thus reduces the area which can be acted on mechanically. However, there is no sticking/sintering to the recording medium 20. In the case of such fixing on the recording medium 20 and/or in certain embodiments in the case of complete fixing of the printing material 200 with a closed printing material layer on the recording medium, there is the risk that, upon final fixing, what is known as "blistering" occurs, that is to say microexplosions under the top layer, which can result in tearing of the top layer of the printing material 200 and/or damage to the recording medium 20.

A preferred printing material 200 of the present invention is a liquid developer comprising particles, for example resin toner particles, which preferably have a melting point of less than 120° C., more preferably of less than 110° C. and particularly preferably of less than 100° C. In this connection, the liquid developer can be in the form of particles in liquid, for example in an oil such as mineral oil. However, the present invention is not limited thereto, and solid toner or dry toner, as used in laser printers and copiers, or other printing particles, and other printing material which preferably has a melting point of less than 120° C., more preferably of less than 110° C. and particularly preferably of less than 100° C., are also conceivable as printing material 200. However, it is necessary for at least portions on the surface of the printing material 200 to be melted in part by the steam in order for bonding/partial sintering of the printing material 200 to occur. It is thus also conceivable to use printing material in particle form in certain embodiments, in which the ink particles/toner particles cannot be melted by the superheated steam 300, but this is surrounded by a thin layer of material which can be melted by the superheated steam and which is preferably transparent and is then melted by the superheated steam 300 at least in part.

The quantity of superheated steam 300 applied is not particularly limited as long as the printing material 200 is sintered at least in part. Thus, for example—on the basis of paper of 19 inch width at a printing speed of 1 m/s—a quantity of superheated steam 300 which corresponds to at most 20 l/h water and press line, preferably 10 l/h and less and more preferably 7.5 l/h, for example 5 l/h and less, can be used.

Furthermore, the recording medium 20 is also not particularly limited and can include all possible forms of recording media 20 which are usually used in printers and/or copiers, such as paper, cardboard, coated materials, packaging, metal films, cloth, etc. In preferred embodiments, hygrophilic or moisture-containing printing materials 200 are used, in which case, by the application of the superheated steam 300, remoistening can take place and also in certain embodiments moisture loss of the recording medium 20 can be avoided.

In certain embodiments, during intermediate fixing the recording medium, for example paper and cardboard, is preheated to a certain temperature, for example to at least 50° C., preferably at least 55° C. and more preferably 60° C. and above, at least on the side of the simplex print image, or on the two sides, in order to promote the partial melting of the printing material 200, depending on the glass transition temperature or the melting point of the printing material 200 or parts of the printing material 200, for example in the case of coated printing materials. The recording medium preferably has a temperature of 100° C. or less, more preferably 90° C. or less, more preferably 80° C. or less and particularly preferably 70° C. or less, in certain embodiments approximately 60° C., in order to prevent the printing material 200 from sintering to the recording medium 20 during the intermediate fixing. Heating can take place by heating apparatuses which are conventional in printers.

Upon application of the superheated steam 300, a protective film of water can additionally be formed on the printing material and/or the recording medium 20 owing to the formation of water droplets by the condensation of the superheated steam by impingement cooling, which protective film prevents the print image being damaged by the pressure roller 126 during further printing in the duplex printing apparatus 12. In certain embodiments it is possible for such a protective film to pass unscathed through a plurality of printing units. It is thus possible for an aqueous protective film to be observed on the recording medium by the naked eye during the back printing.

In addition to a protective film on the print image, when water droplets are produced the water can also be deposited directly in the printing material, for example in a toner/carrier layer, and thus additionally reduces the electrophoretic mobility in the unfixed toner layer.

In preferred embodiments, when charge control agents (CCA) are used in a carrier liquid of the printing material in, for example, digital printers, as set out above, a further effect of stabilisation can occur in that, after application, the water of the water droplets dissociates from the charge control agents provided with a charge as a result of the printing operation. In this connection, a charged charge control agent $CCA^-$ can for example react with the hydronium ions $H_3O^+$ resulting from the self-dissociation of water.

The charge control agents, which usually stick to printing material particles, for example a toner, during printing and thus impart a charge thereto, become neutral as a result, such that the charge of the printing material particles is also reduced, for example also in connection with a migration of the charge control agents from the surface of the printing material particles into the carrier liquid. As a result, when an electric field is used for printing on the second side, such "discharged" toner particles of the print image on the first side are thus no longer influenced by the field—that is to say, the electrophoretic mobility of the toner particles decreases—and therefore they also cannot be drawn onto the impression roller.

Alternatively, it is also conceivable for protons from the surface of printing material particles to react with hydroxide ions $OH^-$, and this can likewise lead to a reduction of the charge of the printing material particles.

The effect of the charge neutralisation increases with increasing temperature, it also being possible for improved penetration of the carrier into the recording medium to take place owing to the reduction of the viscosity.

Owing to the dissociation, the pH also drops, and this likewise reduces the electrophoretic mobility.

It is also conceivable for the water to penetrate the toner/carrier layer through the application, such that this layer then becomes electrically conductive and an electric field no longer has an effect on it.

The invention is based on a method and a device for intermediate fixing of a recording medium intended for two-sided printing. The aim is to intermediately fix the simplex print image located on the front in such a way that it remains as undamaged as possible on the front, for example in the case of an electrophoretically assisted transfer on the back.

The problem is solved by pre-fixing the simplex print image by superheated steam. For this purpose, the unfixed print image is exposed to hot, saturated steam without condensation nuclei for a certain period, for example for more than 1 second. The method can be used for variable printing speeds and different types of recording medium, for example different types of paper, over the length of the steam path.

Owing to the high energy input of the superheated steam as a result of the large heat capacity of water compared to air, very rapid intermediate fixing of the print image takes place.

At the same time, when a hygrophilic or moisture-containing recording medium such as paper or cardboard is used, this is exposed to a saturated atmosphere such that it does not dry out in certain embodiments.

Since the moistening takes place over a prolonged period of time, in certain embodiments it can be avoided that the moisture owing to the superheated steam 300 in the recording medium 20 increases so much that it affects the print quality.

However, swelling of the paper in the sub-micrometer range can still occur for example upon moistening of a paper surface, which swelling is relevant to register. In order to counteract this effect, the paper can be re-cooled downstream of the steam path in certain embodiments. Strong fans, for example, are sufficient for this, but the cooling apparatus **29*a*** is not limited thereto.

If the simplex print image of the front, fixed by steam, is fed to the duplex printing unit 12, retransfer onto a pressure roller owing to the influence of an electric field will no longer occur. The print image is also not damaged by contact with the impression roller 126.

The method can also be used for final fixing of the print image. Besides the lack of drying of the recording medium 20, for example paper or cardboard, the advantage of the method is also that, owing to the high energy input, the temperatures with superheated steam are considerably lower than with comparative methods and there is no risk of, for example, paper fire or paper browning.

Thus, for example, no relevant discharge of potentially explosive vapours could be detected during intermediate fixing, and therefore in certain embodiments all measures which would be taken in the context of explosion prevention (DIN 1539) and the observance of the limit values for exhaust air (TA-Luft (German technical instructions on air quality control) & BlmSchG (German Federal Immission Control Act)) can be omitted.

The method can be used for variable printing speeds over the length of the application path of the superheated steam 300.

In this connection, the quantity of superheated steam 300 to be applied can depend on the area of the recording medium 20 and the number of separations/printing operations in the simplex printing apparatus 11. The degree of coverage, however, that is to say the area of printing material 200 on the recording medium 20, plays only a secondary role or no role.

In particular when applying printing material 200 having mineral oil or similar substances as carrier liquid of the printing material 200, the number of colour separations can be important, since the quantity of carrier liquid increases with each application, and therefore more superheated steam 300 is also required. In certain embodiments the superheated steam can penetrate the carrier liquid at least in part into the recording medium 20, for example paper.

The presence of water after the intermediate fixing can be visualised for example by thermography. It is also possible in certain embodiments to determine the uniformity of the applied water during intermediate fixing using inline systems by known measurement methods. The intermediate fixing, for example the degree of crosslinking, by the superheated steam 300 can also be determined by known measurement methods by inline systems.

The present invention makes it possible to solve in a technically simple and economical manner the problem of intermediate fixing in the case of two-sided printing on a recording medium 20.

It represents a gentle and economical method for the recording medium 20 as a result of rapid intermediate fixing owing to high energy density of steam, a small installation space owing to high energy density of steam, and no or only slight drying out of the recording medium, for example the fibres of paper.

The transfer for the duplex printing is not impaired by the intermediate fixing and high levels of accuracy in the front and back register can be achieved. In addition, there is no optical alteration of the print image (gloss, etc.) since the method is contact-free.

The present invention is thus a technical and economical solution to the problem of intermediate fixing by simple and compact construction, in particular by a simple and cost-effective construction compared to a "conventional" fixing station.

In addition, water is freely available and is not subject to any hazardous substance values. When using paper, there is also no risk with regard to paper fire and browning, since the paper temperature is 100° C. or less.

When using the printing arrangement according to the invention, a printing method can be carried out in which there is no negative effect on the simplex print image during duplex printing, since the simplex print image has previously been fixed by superheated steam 300. By using superheated steam 300, it is also possible to avoid a negative influence on the recording medium 20, for example by thermal intermediate fixing, and therefore the recording medium 20 is also not influenced by the printing method. This results in an improved recording medium 20 printed on two sides, in that a uniformly large print image in the original size of the simplex print image can be obtained on the two sides without there being a negative influence on the material of the recording medium 20.

These effects thus preferably occur when using recording media 20 which are negatively influenced by heat and/or which deteriorate as a result of moisture loss, such as paper and cardboard.

LIST OF REFERENCE NUMERALS

10 digital printer
11, 11*a*-11*d* printing unit (simplex printing apparatus)
12, 12*a*-12*d* printing unit (duplex printing apparatus)
20 recording medium
20' print image (toner)
20" transport direction of the recording medium
21 reel (input)
22 unwinder
23 conditioning unit
24 turning device
25 register unit
26 draw unit
27 rewinder
28 reel (output)
29 intermediate fixing apparatus
29*a* cooling apparatus
30 final fixing apparatus
40 air conditioning module
50 power supply
60 controller
70 liquid management
71 liquid control unit
72 reservoir
100 electrophotography station
101 photoconductor roller
102 erasing light
103 cleaning apparatus (photoconductor)
104 blade (photoconductor)
105 collecting container (photoconductor)
105' arrow
106 charging device (corotron)
106' wire
106" screen
107 air supply duct (aeration)
108 exhaust air duct (venting)
109 character generator
110 developer station
111 developer roller
112 supply chamber
112' liquid inlet
113 antechamber
114 electrode segment
115 metering roller (developer roller)
116 blade (developer roller)
117 cleaning roller (developer roller)
118 blade (cleaning roller for the developer roller)

119 collecting container (liquid developer)
119' liquid drain
120 transfer station
121 transfer roller
122 cleaning unit (wet chamber)
123 cleaning brush (wet chamber)
123' cleaning liquid inlet
124 cleaning roller (wet chamber)
124' cleaning liquid drain
125 conditioning element (retaining plate)
126 impression roller
127 cleaning unit (impression roller)
128 collecting container (impression roller)
128' liquid drain
129 charging unit (corotron at transfer roller)
200 printing material, printing material particles
200*a* partially fixed printing material
201 strongly sintered printing material
201*a* printing material sintered to recording medium 20
291 steam generator
292 cyclone separator
293 steam inlet
294 steam distributor
295 web guide roller
296 microporous rod
297 web guide roller
298 perforated plate
299 shaft
299*a* steam outlet opening
299*b* housing
300 superheated steam
I unfixed recording medium after simplex printing
II application of superheated steam 300
III intermediate fixing by the superheated steam 300

What is claimed is:

1. A printing method for two-sided printing on a recording medium, in which method two opposing sides of a recording medium are printed on, comprising:

providing at least one simplex printing apparatus, at least one duplex printing apparatus and a recording medium to be printed on;

printing on a first side of the recording medium using the simplex printing apparatus;

intermediately fixing the first side of the recording medium, printed on by the simplex printing apparatus, using superheated steam;

printing on a second side of the recording medium, which second side is arranged opposite the first side which has been printed on by the simplex printing apparatus and intermediately fixed, using the duplex printing apparatus.

2. The printing method of claim 1, wherein the intermediate fixing by superheated steam takes place for a time period of more than one second.

3. The printing method of claim 1, wherein the recording medium is cooled after the intermediate fixing.

4. The printing method of claim 1, wherein the recording medium is turned after printing by the simplex printing apparatus and before printing by the duplex printing apparatus, the turning taking place before or after the intermediate fixing.

5. The printing method of claim 1, wherein during intermediate fixing, the superheated steam is applied to the recording medium at a preset pressure, in particular at a pressure above the ambient pressure.

6. A recording medium printed on two sides, wherein it is produced by the printing method according to claim 1.

* * * * *